US005925838A

United States Patent [19]

Meng-Suen

[11] Patent Number: 5,925,838

[45] Date of Patent: Jul. 20, 1999

[54] MUSICAL DEVICE WITH UNDAMPED SOUND

[75] Inventor: Huang Meng-Suen, Kowloon, The Hong Kong Special Administrative Region of the People's Republic of China

[73] Assignee: Mr. Christmas, Inc., New York, N.Y.

[21] Appl. No.: 08/873,019

[22] Filed: Jun. 11, 1997

[51] Int. Cl.[6] ..... G10F 1/08

[52] U.S. Cl. ..... 84/102; 84/404; 446/336; 446/418

[58] Field of Search ..... 84/102, 403, 404, 84/405; 446/298, 418, 336, 353, 420

[56] References Cited

U.S. PATENT DOCUMENTS

| | | | |
|---|---|---|---|
| 541,471 | 6/1895 | Corey . | |
| 848,658 | 4/1907 | Kampelman . | |
| 2,250,827 | 7/1941 | Fathauer | 84/102 |
| 3,186,157 | 6/1965 | Favret et al. . | |
| 3,649,737 | 3/1972 | Jespersen . | |
| 4,184,398 | 1/1980 | Siegelman . | |
| 4,428,313 | 1/1984 | Takiguchi et al. . | |
| 4,567,804 | 2/1986 | Sawase et al. . | |
| 4,730,284 | 3/1988 | Adams . | |
| 4,870,335 | 9/1989 | Koshida et al. . | |
| 4,945,330 | 7/1990 | Arita . | |
| 5,119,253 | 6/1992 | Kotani . | |
| 5,266,732 | 11/1993 | Suzuki . | |
| 5,270,480 | 12/1993 | Hikawa . | |
| 5,276,270 | 1/1994 | Kondo . | |
| 5,446,236 | 8/1995 | Nakada et al. . | |

*Primary Examiner*—William M. Shoop, Jr.
*Assistant Examiner*—Shih-yung Hsieh
*Attorney, Agent, or Firm*—Fitzpatrick, Cella, Harper & Scinto

[57] ABSTRACT

A musical device includes a mounting base, a plurality of sound producing bodies, and a plurality of striking mechanisms for striking the sound producing bodies to create a melody. Each striking mechanism includes two striking arms, each for striking a respective sound producing body at a striking position. Each striking mechanism includes a driving device for driving each striking arm from a rest position to a position intermediate the rest position and the striking position. The momentum of the striking arm carries the striking arm from the intermediate position to the striking position while the striking arm is not in contact with the driving device. This enables the musical device to recreate desired tones without any damping.

48 Claims, 4 Drawing Sheets

MUSICAL DEVICE WITH UNDAMPED SOUND

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a musical device in which a sound producing body is struck by a swinging member. In particular, the present invention relates to a musical device in which the swinging member is free to recoil upon impact with the sound producing body so as to permit undamped sound generation.

In recent years various sound producing toys have been proposed. One example is illustrated in U.S. Pat. No. 5,446,236 (Nakada et al.). In one embodiment of the Nakada patent, the musical toy includes a case housing a pair of permanent magnets, and two swinging assemblies are pivotably mounted to the case in close proximity to the permanent magnets. Each swinging assembly consists of a coil receptacle, a shaft, a supporting stump, a spring, a tapper and an electromagnetic coil. A spring stretches between the coil receptacle and a stopper fixed to the case and biases the swinging assembly in one rotational direction such that the tapper is held aloft. The stopper limits the angle through which the swinging assembly pivots in the one rotational direction. When the electromagnetic coil receives a drive signal, magnetic interaction between the coil and the permanent magnets causes the swinging assembly to rotate about the shaft in the opposite rotational direction. This effect forces the tapper to swing downwardly against the elastic force of the spring and strike the sound producing body, thus producing a sound. However, the apparatus of the Nakada patent utilizes a complex electromagnetic drive and it would be difficult to utilize a control system that could manipulate the drive of the tapper to prevent dampening of the produced sound.

In an alternative design, mechanical linkages are driven by electric motors to cause a swinging arm or clapper to strike a sound producing body. However, in conventional designs there is direct contact between the mechanical linkages and the swinging arm at the moment the swinging arm strikes the sound producing body. With this arrangement, the swinging arm is not free to recoil immediately, which can lead to dampening of the sound produced. Thus, it is difficult for these toys to faithfully reproduce a desired melody.

BRIEF SUMMARY OF THE INVENTION

It is, therefore, a principle object of the present invention to provide a musical device that can faithfully reproduce desired melodies with undamped sound production.

It is another object of the present invention to achieve the above object with a simple, reliable design that is inexpensive to manufacture.

In one aspect of the present invention a musical device includes a base, sound producing means provided on the base, and striking means provided on the base adjacent the sound producing means for striking the sound producing means to produce sound. The striking means comprises a striking member for striking the sound producing means at a striking position and driving means for directly driving the striking member from a rest position to an intermediate position between the rest position and the striking position. Momentum of the striking member carries the striking member from the intermediate position to the striking position.

In a further aspect of the present invention a musical device includes a base, a sound producing body provided on the base, and a striking mechanism provided on the base adjacent the sound producing body. The striking mechanism includes a main body attached to the housing, a striking member connectable to the main body for striking the sound producing body, the striking member being movable between a first position remote from the sound producing body and a second position contacting the sound producing body, and driving means for applying a driving force to the striking member at the first position and ceasing applying the driving force when the striking member is at an intermediate position between the first position and the second position. Momentum of the striking member carries the striking member from the intermediate position to the second position to strike the sound producing body.

In yet another aspect of the present invention a musical device includes a base, a sound producing body provided on the base, and a striking mechanism provided on the base adjacent the sound producing body. The striking mechanism includes a main body and a striking arm pivotably connected to the main body at a pivot point, the striking arm having a striking end at one side of the pivot point for striking the sound producing body and a driven end at another side of the pivot point, the striking end being movable between a first position remote from the sound producing body and a second position contacting the sound producing body. The striking mechanism further includes a driving cam provided on the main body for abutting and driving the driven end of the striking arm to drive the striking end of the striking arm from the first position toward the second position, the driving cam abutting the driven end of the striking arm at a contact position when the striking end of the striking arm is at the first position and ceasing abutting the driven end at a release position when the striking end is at an intermediate position between the first position and the second position, and a driving motor for driving the driving cam between the contact position and the release position. After the driving cam reaches the release position and ceases abutting the driven end of the striking arm, momentum of the striking arm carries the striking end from the intermediate position to strike the sound producing body at the second position.

In still another aspect of the present invention a striking mechanism includes a main body, a striking arm pivotably connected to the main body at a pivot point, a driving cam, and a driving motor. The striking arm has a striking end at one side of the pivot point for striking a sound producing body and a driven end at another side of the pivot point. The striking end is movable between a first position remote from the sound producing body and a second position contacting the sound producing body. The driving cam is provided on the main body for abutting and driving the driven end of the striking arm to drive the striking end of the striking arm from the first position toward the second position. The driving cam abuts the driven end of the striking arm at a contact position when the striking end of the striking arm is at the first position and ceases abutting the driven end at a release position when the striking end is at an intermediate position between the first position and the second position. The driving motor drives the driving cam between the contact position and the release position. After the driving cam reaches the release position and ceases abutting the driven end of the striking arm, momentum of the striking arm carries the striking end from the intermediate position to strike the sound producing body at the second position.

These and other aspects, objects and features of the present invention will be more readily understood by taking into consideration the following detailed description and accompanying drawings.

DETAILED DESCRIPTION OF THE INVENTION

Figure 1:
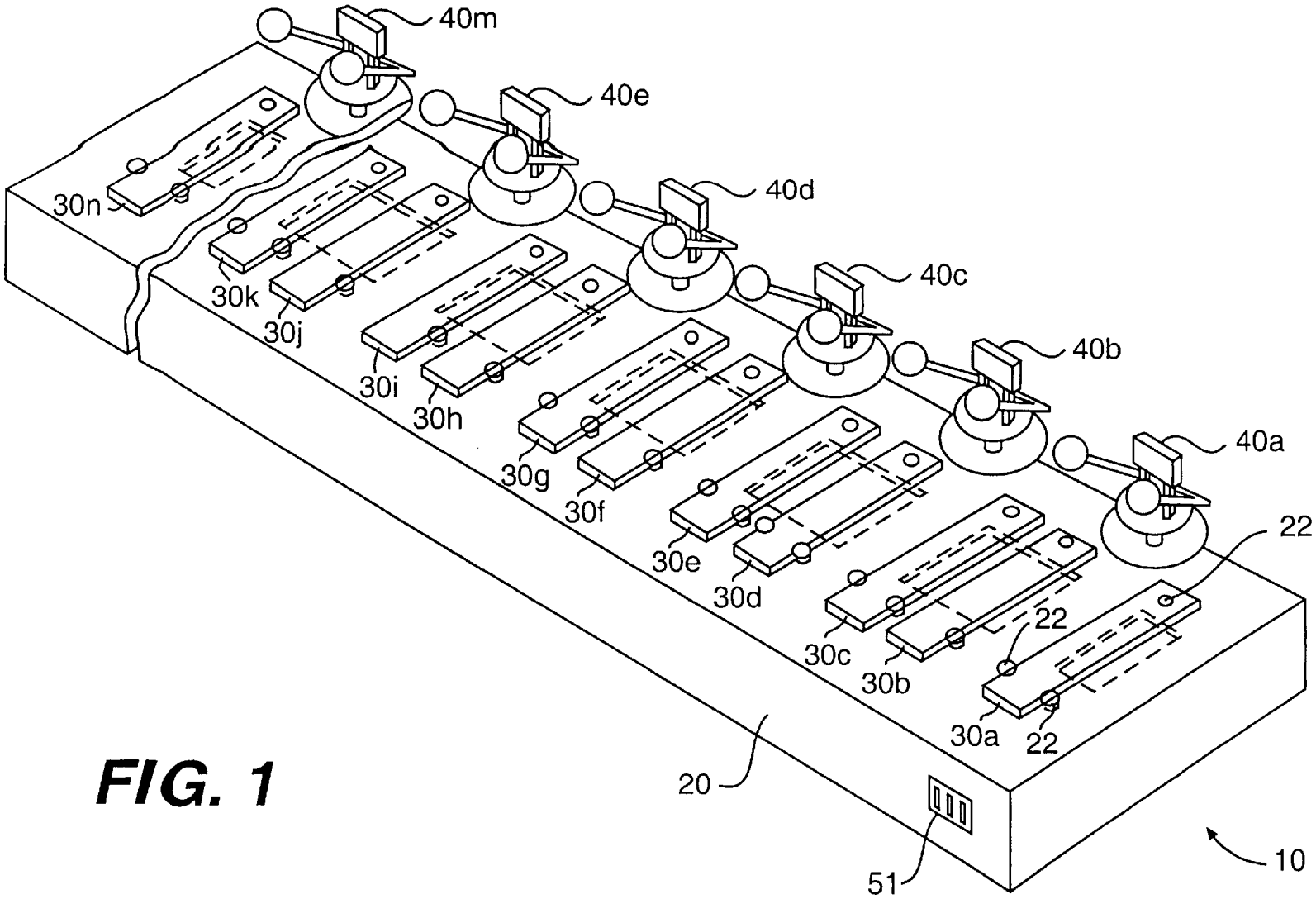
FIG. 1 is a perspective view of the musical device according to the present invention.

The preferred embodiment of the present invention will now be described in detail, with reference to the accompanying drawings. FIG. 1 is an overall perspective view of the musical device 10 according to a preferred embodiment of the present invention. The musical device is comprised of a base 20, a plurality of sound producing bodies 30*a*, 30*b*, 30*c*, . . . , 30*n* mounted on the base, and a plurality of striking mechanisms or striking FIGS. 40*a*, 40*b*, 40*c*, . . . , 40*m* also mounted on the base 20. Generally speaking, the striking figures are actuated to strike the sound producing bodies to create sound. By operating the striking figures in a controlled manner, the sound producing bodies are struck to create music.

The sound producing bodies 30*a*, 30*b*, 30*c*, . . . , 30*n* can be in the form of any type of percussion element. In the preferred embodiment, the sound producing bodies are in the form of metal or wooden bars that each produce a different predetermined tone when struck. Thus, in the preferred embodiment, the musical device is in the form of a xylophone. However, the sound producing bodies can be any other type of device that produces a predetermined tone when struck, such as chimes, bells and musical strings or wires.

The sounding producing bodies 30*a*, 30*b*, 30*c*, . . . , 30*n* are mounted on the base 20 with mounting studs 22. An elastic spacer can be disposed around the mounting studs between the sound producing bodies 30*a*, 30*b*, 30*c*, . . . , 30*n* and the base 20 to raise those bodies above the base and allow them to vibrate freely when struck. Recesses 24 can also be formed in the base 20 below the sound producing bodies to improve the resonance of their sound.

The striking mechanisms or FIGS. 40*a*, 40*b*, 40*c*, . . . , 40*m* are mounted on the base 20 adjacent the sound producing bodies 30. Each striking mechanism preferably has two striking arms, with each striking arm striking a different sound producing body 30. Therefore, there are preferably twice as many sound producing bodies 30 as there are striking mechanisms 40, such that 2 m equals n.

While the striking mechanisms or figures are illustrated generically without distinguishing characteristics, they can be formed as humans, animals, or in any other decorative way desired.

Figure 2:
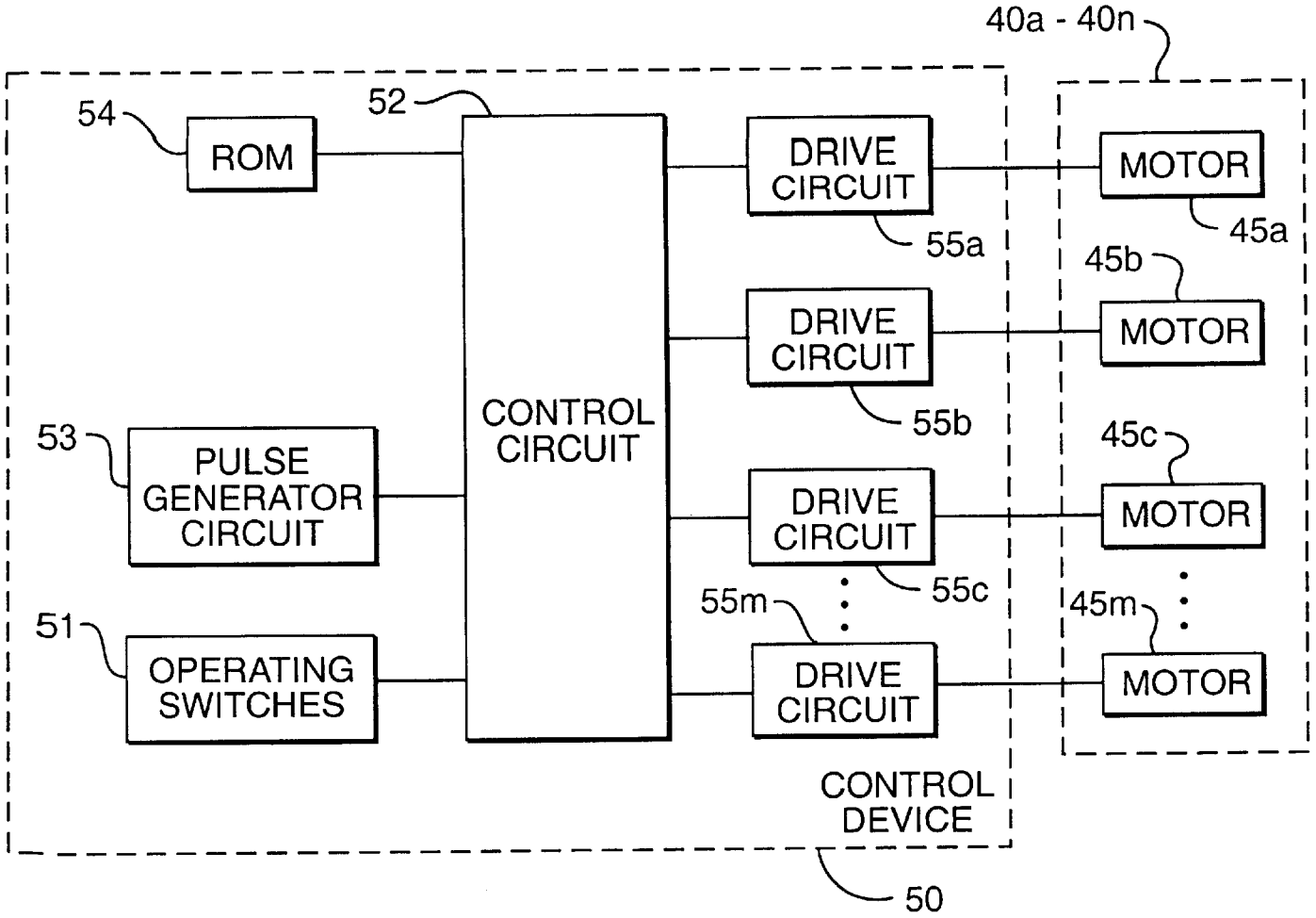
FIG. 2 is a schematic diagram of the control arrangement of the musical device of the present invention.

The control system for controlling the motions of the striking mechanisms 40 will now be described with respect to FIG. 2. The control system 50 comprises operating switches 51, a control circuit 52, a pulse generator circuit 53, a ROM 54 and drive circuits 55*a*, 55*b*, 55*c*, . . . , 55*m*. The operating switches 51 can include one or more switches including a starting switch and a melody selection switch. The operating switches 51 are connected to the control circuit 52, which is comprised of a microcomputer. The pulse generator circuit 53 generates fixed cycle timing pulses and outputs the pulse signals to the control circuit 52. The ROM 54 stores data generating specific melody signals. The control circuit 52 thus generates melody drive signals based on the signals from the data stored in the ROM 54. Drive circuits 55*b*, 55*c*, . . . , 55*m* are connected to the control circuit 52 and are respectively connected to driving motors 45*a*, 45*b*, 45*c*, . . . , 45*m* of the striking mechanisms 40*a*, 40*b*, 40*c*, . . . , 40*m*. Accordingly, the drive circuits 55*b*, 55*c*, . . . , 55*m* supply the melody drive signals in pulse form to the respective motors 45*a*, 45*b*, 45*c*, . . . , 45*m* in response to signals from the control circuit 52.

The ROM 54 stores information representing various melodies, which can be read when designated by the melody selection switch of the operating switches 51. The ROM 54 can be replaceable, whereby the control system of the invention can provide a virtually limitless selection of melodies for play.

Figure 3:
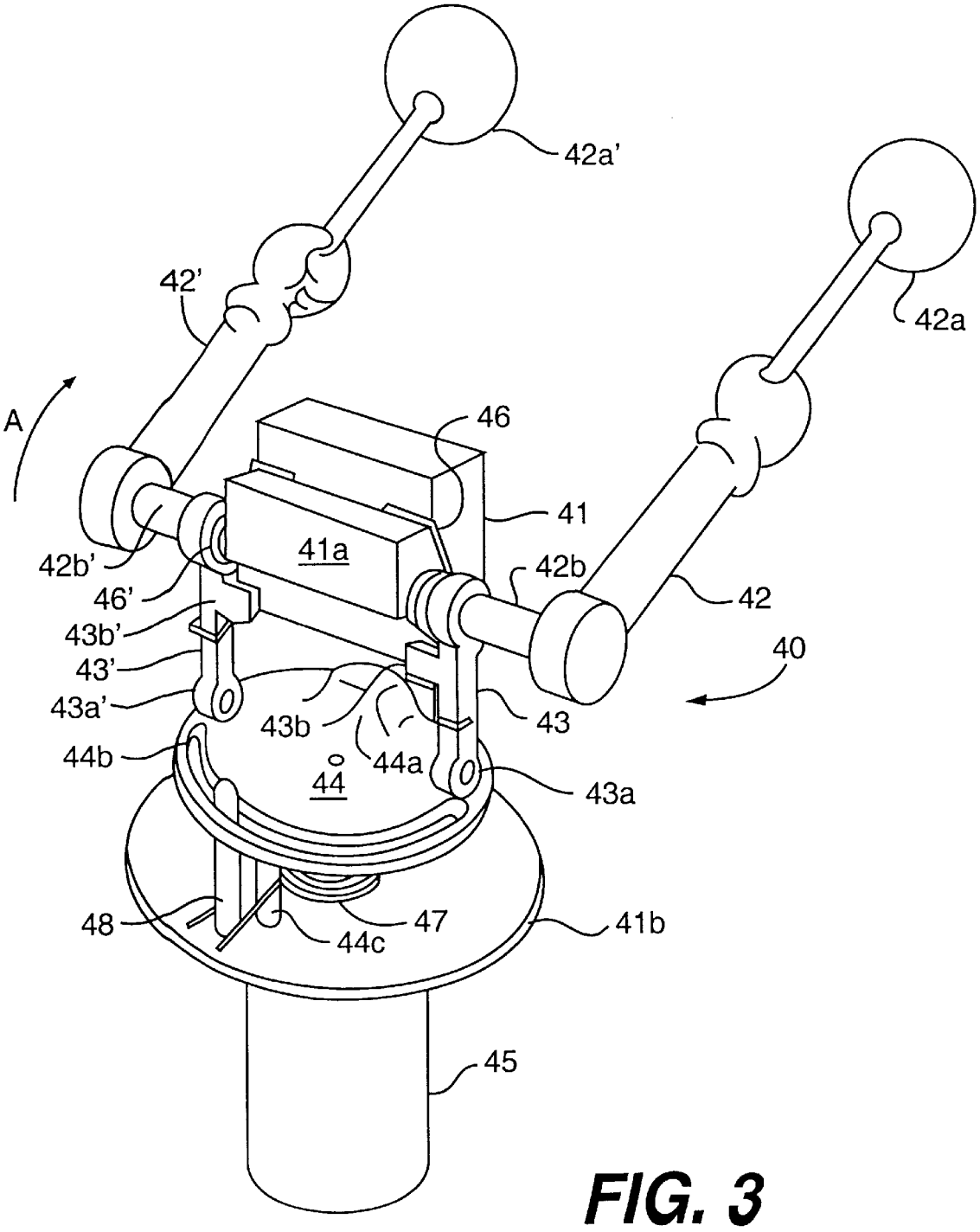
FIG. 3 is a perspective view of the working elements of a striking mechanism of the musical device of the present invention.

Each of the striking mechanisms or FIGS. 40 is formed identically, and an example of one striking mechanism as shown in FIG. 3 will now be described. Each striking body 40 is comprised of a main chassis or body 41 supported in a fixed position by structure (not shown). This main chassis 41 can be formed in any desired shape such that the striking body 40 can resemble a striking or drumming figure, such as a drummer boy, drumming elf, drumming bear, etc. Alternatively, ornamental features can be disposed over the main chassis after assembly to achieve the appearance of a striking or drumming figure.

Right and left drumming or striking arms 42, 42' are pivotably connected to a bearing portion 41*a* of the main chassis 41. Each striking arm 42, 42' includes a striking end 42*a*, 42*a'* which is preferably in a shape of a mallet or drum stick. Each striking arm 42, 42' further includes a rotatable shaft 42*b*, 42*b'* that can be journalled in the bearing portion 41*a* of the main chassis 41. One driving arm 43, 43' is fixed to each shaft 42*b*, 42*b'* of the respective striking arms 42, 42' such that when a driven end 43*a*, 43*a'* of the driving arm 43, 43' is moved, the shaft 42*b*, 42*b'* will rotate and cause its striking end 42*a*, 42*a'* to swing downwardly. Each striking arm 42, 42*a'* can be integrally formed with a driving arm 43, 43'.

An arm torsional biasing spring 46, 46' is provided for biasing each driving arm 43, 43' to a home, or rest, position. Each spring 46, 46' has one end anchored by the main chassis and another end abutting the driving arm 43, 43' so as to urge the striking end 42*a*, 42*a'* of the striking arm 42, 42' upwardly. A stop 43*b*, 43*b'* is formed on each driving arm 43, 43' to establish the rest position of the striking arm 42, 42'. In the rest position the stop 43*b*, 43*b'* abuts a rear portion of the main chassis. The biasing force of the biasing spring 46, 46' is just sufficient to maintain the striking arm 42, 42' in the rest position when no driving force is applied to its associated driving arm 43, 43'. Therefore, minimal driving force is required to counteract this spring biasing force. In this way, the power of the driving source, to be described below, can be minimized to reduce the cost of the device.

The chassis 41 further includes a mounting base 41*b* onto which a driving motor 45 is mounted. The driving motor 45 is preferably a rotating DC motor which can drive in both clockwise and counter-clockwise directions when viewed from above, depending on the polarity of the drive signal. The mounting base 41*b* of the main chassis 41 can also be used to secure the striking mechanism 40 to the base 20 of the musical toy. As shown in FIG. 1, the mounting base 41*b* is provided flush with the upper surface of the base 20, such that the motor 45 is hidden within the base 20.

The drive shaft of the motor 45 is connected to an actuator cam disk 44 to drive the disk 44 in clockwise and counter-clockwise directions. The cam disk 44 is provided with an upwardly projecting cam lobe 44*a* which can be integrally formed thereon. The cam disk 44 is positioned such that when it is rotated in one direction (i.e., clockwise) the cam lobe 44*a* will contact the driven end of the right driving arm 43 and when driven in the opposite direction (i.e., counter-clockwise) will contact the driven end of the left driving arm 43'.

A slot 44*b* for limiting rotation in either direction is formed in the cam disk 44. A stopper 48 is fixed to the mounting base 41*b* and is fitted into the limiting slot 44*b*. The rotational range of the cam disk 44 is limited in one direction when one end of the limiting slot 44*b* contacts the stopper 48 and in the other direction when the other end of the limiting slot 44*b* contacts the stopper 48.

A disk torsional biasing spring 47, having opposing fingers 47*a*, 47*b*, is disposed surrounding the drive shaft of the motor 45 between the mounting base 41*b* and the cam disk 44. A spring actuator 44*c* extends from the cam disk 44. One finger 47*a* of the biasing spring 47 contacts one side of the stopper 48 and spring actuator 44*c* and the other finger 47*b* of the spring 47 contacts the opposite sides of the stopper 48 and spring actuator 44*c*. In other words, the stopper 48 and the spring actuator 44*c* are sandwiched between opposite fingers of the biasing spring 47.

When the cam disk 44 is rotated in one direction, a first finger of the spring 47 will be anchored by the stopper 48 and a second finger will travel with the spring actuator 44*c*. When the driving force is no longer applied to the cam disk 44 the biasing spring 47 will urge the spring actuator 44*c* back to the centered position adjacent the stopper 48. When the cam disk 44 is driven in the opposite direction, the second end of the spring 47 will be anchored by the stopper 48 and the first finger of the spring 47 will travel with the spring actuator 44*c* to be returned to the centered position when the driving force is ceased.

As will be appreciated, the chassis 41 may be secured to the mounting base 41*b* by structure that is not shown but that allows relative rotation between the chassis 41 and the cam disk 44.

Figure 4:
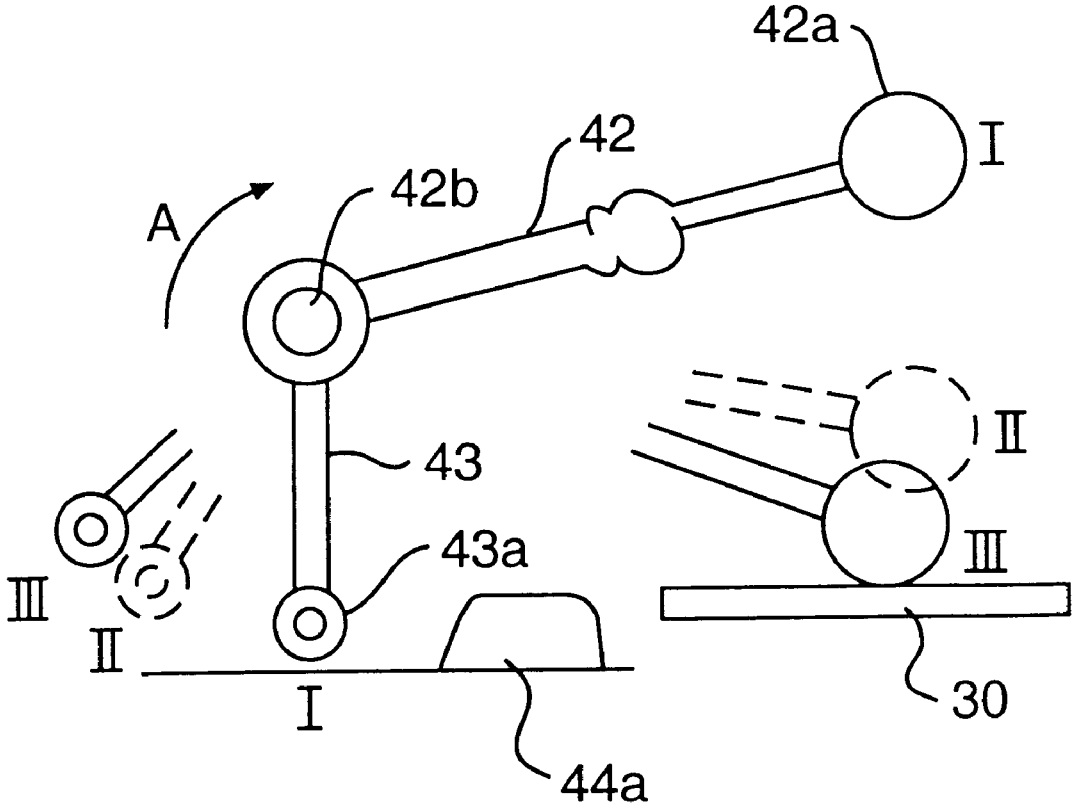
FIG. 4 is an explanatory diagram of the actuation of a striking arm of the striking mechanism according to the present invention.

Referring to FIGS. 3 and 4, the operation of the striking mechanism 40 will now be described. When driving signals are applied to the motor 45 and the cam disk 44 is driven in, for example, clockwise direction, the cam 44*a* is driven toward the driven end 43*a* of the right driving arm 43. At this time the right striking arm 42 and the right driving arm 43 are biased to the rest position by the right arm retaining spring 46. This first position is identified by position I in FIG. 4.

As the cam disk 44 continues to rotate, a sloping leading face of the cam lobe 44*a* contacts the driven end 43*a* of the right driving arm 43. This contact forces the driving arm 43, the shaft 42*b* and the striking arm 42 to rotate in the clockwise direction of arrow A. This causes the striking end 42*a* of the right striking arm 42 to swing downwardly toward the sound producing body 30.

When the end of the limiting slot 44*b* of the cam disk 44 contacts the stopper 48, the driven end 43*a* of the right driving arm 43 and the striking end 42*a* of the right striking arm 42 are in an intermediate position, i.e., the position II shown in FIG. 4. As will be appreciated, in the intermediate position, the striking end 42*a* of the right striking arm 42 is not yet in contact with the sound producing body 30.

The cam disk cannot rotate past an attitude that positively produces the intermediate position II, and, if driving force from the motor 45 ceases, the cam disk 44 is biased back toward its centered (or home) position by the biasing spring 47. At this time, the cam disk 44 no longer drives either of the driving arms 43, 43'. However, the configuration of the driving arm 43 and striking arm 42, including the distribution of their mass, is selected such that momentum of the right striking arm 42 and the right driven arm 43 carries the striking end 42*a* of the right striking arm 42 toward the sound producing body 30 until it strikes the sound producing body as shown by a second position (i.e., position III in FIG. 4). Since the cam lobe 44*a* is not in contact with the driven end 43*a* of the right driving arm 43 at this point, the striking end 42*a* of the arm is free to rebound off the sound producing body 30 and thus not dampen the sound produced by the sound producing body.

As described above, when the driving pulse ceases driving the driving motor 45, the disk retaining spring 47 biases the cam disk 44 back to the center position so that the cam 44*a* returns to its rest position. On the other hand, after the striking end 42*a* of the arm 42 strikes the sound producing body, the right arm retaining spring 46 as well as the reaction of the impact between the end 42*a* and body 30 return the right striking arm 42 and the right driven arm 43 to their rest positions shown at I. The striking body 40 is then ready to strike again. If an opposite driving pulse is applied to the motor 45, the cam disk 44 will be rotated in the counter-clockwise direction to drive the left striking arm 42' in the same manner as described with reference to the right striking arm 42.

The overall operation of the musical toy will now be described. When the starting switch of the operation switches 51 is switched ON, a starting signal is output to the control circuit 52 to activate it. Based on the data from the ROM 54 and the pulse generator circuit 53, the control circuit 52 creates a melody drive signal for performing a specific melody. This signal is selectively divided by musical notes and the signal for each musical note is supplied through the respective drive circuits 55*b*, 55*c*, . . . , 55*m* to drive the specific driving motors 45*a*, 45*b*, 45*c*, . . . , 45*m* in a desired direction. Depending on the polarity, each driving signal will cause either the left or right striking arm 42, 42' of a particular striking mechanism or FIG. 40 to strike a respective sound producing body 30 to generate a desired note in the manner described above. Thus, specific melody sounds can be reproduced without any dampening.

The individual components shown in outline or designated by blocks in the drawings are all well-known in the electronic control arts and their specific construction and operation are not critical to the operation or best mode for carrying out the invention.

While the present invention has been described with respect to what is currently considered to be the preferred embodiments, it is to be understood that the invention is not limited to them. To the contrary, the invention is intended to cover various modifications and equivalent arrangements within the spirit and scope of the appended claims. The scope of the following claims is to be accorded the broadest interpretation so as to encompass all such modifications and equivalent structures and functions.

I claim:

1. A musical device comprising:

a base;

sound producing means provided on said base; and striking means provided on said base adjacent said sound producing means for striking said sound producing means to produce sound, said striking means comprising a striking member for striking said sound producing means at a striking position and driving means for directly driving said striking member from a rest position to an intermediate position between the rest position and the striking position, said striking member being configured such that momentum of said striking member carries said striking member from the intermediate position to the striking position.

2. A musical device according to claim 1, further comprising control means for controlling said striking means to strike said sound producing means at predetermined times.

3. A musical device according to claim 1, further comprising second sound producing means and said striking means further comprising a second striking member, wherein said driving means selectively drives said striking member and said second striking member to strike said sound producing means and said second sound producing means, respectively.

4. A musical device according to claim 3, further comprising control means for controlling said striking means and said second striking means to strike said sound producing means and said second sound producing means, respectively, at predetermined times.

5. A musical device according to claim 1, wherein said sound producing means and said striking means are provided in plural number on said base.

6. A musical device comprising:

a base;

a sound producing body provided on said base; and a striking mechanism provided on said base adjacent said sound producing body, said striking mechanism comprising:

a main body supported relative to said base, a striking member connectable to said main body for striking said sound producing body, said striking member being movable between a first position remote from said sound producing body and a second position contacting said sound producing body, and driving means for applying a driving force to said striking member at the first position and ceasing applying the driving force when said striking member is at an intermediate position between the first position and the second position, said striking member being configured such that momentum carries said striking member from the intermediate position to the second position to strike said sound producing body.

7. A musical device according to claim 6, wherein said striking member comprises a lever arm mounted for pivoted movement relative to about said main body, said lever arm comprising a striking end for striking said sound producing body and a driver end for being driven by said driving means.

8. A musical device according to claim 6, wherein said driving means comprises a cam for driving said striking member.

9. A musical device according to claim 8, wherein said driving means further comprises a driving body on which said cam is mounted and a driving source for moving said driving body.

10. A musical device according to claim 9, wherein said driving body comprises a rotating disk and means for normally biasing said disk toward a home position.

11. A musical device according to claim 10, further comprising a stop for limiting rotation of said rotating disk at a location corresponding to where said cam is contacting said striking member when said striking member is at the intermediate position.

12. A musical device according to claim 6, wherein said sound producing body comprises a chime.

13. A musical device according to claim 6, wherein said sound producing body comprises a bell.

14. A musical device according to claim 6, further comprising control means for controlling said driving means to drive said striking member at predetermined times.

15. A musical device according to claim 6, further comprising a second sound producing body having a tone different from that of said sound producing body and said striking mechanism further comprising a second striking member driven by said driving means independently of said striking member to strike said second sound producing body.

16. A musical device according to claim 15, further comprising control means for controlling said driving means to selectively drive said striking member and said second striking member to respectively strike said sound producing body and said second sound producing body at predetermined times.

17. A musical device according to claim 6, further comprising means for biasing said striking member toward the first position.

18. A musical device according to claim 6, wherein said sound producing body and said striking mechanism are provided in plural number on said base.

19. A musical device comprising:

a base;

a sound producing body provided on said base; and a striking mechanism provided on said base adjacent said sound producing body, said striking mechanism comprising:

a main body attached to said base, a striking arm pivotably connected to said main body at a pivot point, said striking arm having a striking end remote from the pivot point for striking said sound producing body and a driven end remote from the pivot point, said striking end being movable between a first position spaced from said sound producing body and a second position contacting said sound producing body, a driving cam provided on said main body for abutting and driving said driven end of said striking arm to drive said striking end of said striking arm from the first position toward the second position, said driving cam abutting said driven end of said striking arm at a contact position when said striking end of said striking arm is at the first position and ceasing abutting said driven end at a release position when said striking end is at an intermediate position between the first position and the second position, and a driving motor for driving said driving cam between the contact position and the release position, wherein said striking arm is configured such that after said driving cam reaches the release position and ceases abutting said driven end of said striking arm, momentum of said striking arm carries said striking end from the intermediate position to strike said sound producing body at the second position.

20. A musical device according to claim 19, further comprising a driving plate on which said cam is mounted, wherein said driving motor drives said driving plate to drive said driving cam.

21. A musical device according to claim 20, wherein said driving plate comprises a rotating disk and means for biasing the plate toward a home position.

22. A musical device according to claim 21, further comprising a stop for limiting rotation of said rotating disk when said cam is at the release position.

23. A musical device according to claim 19, wherein said sound producing body comprises a chime.

24. A musical device according to claim 19, wherein said sound producing body comprises a bell.

25. A musical device according to claim 19, further comprising control means for controlling said driving motor to drive said cam to drive said striking arm at predetermined times.

26. A musical device according to claim 19, further comprising a second sound producing body having a tone different from that of said sound producing body and said striking mechanism further comprising a second striking arm driven by said cam and said driving motor independently of said striking arm to strike said second sound producing body.

27. A musical device according to claim 26, further comprising control means for controlling said driving motor to selectively drive said striking arm and said second striking arm to respectively strike said sound producing body and said second sound producing body at predetermined times.

28. A musical device according to claim 19, further comprising means for normally biasing said striking arm toward the first position.

29. A musical device according to claim 19, wherein said sound producing body and said striking mechanism are provided in plural number on said base.

30. A striking mechanism comprising:

a main body;

a striking arm pivotably connected to said main body at a pivot point, said striking arm having a striking end remote from the pivot point for striking a sound producing body and a driven end remote from the pivot point, said striking end being movable between a first position spaced from the sound producing body and a second position contacting the sound producing body;

a driving cam provided on said main body for abutting and driving said driven end of said striking arm to drive said striking end from the first position toward the second position, said driving cam abutting said driven end of said striking arm at a contact position when said striking end of said striking arm is at the first position and ceasing abutting said driven end at a release position when said striking end is at an intermediate position between the first position and the second position; and a driving motor for driving said driving cam between the contact position and the release position, wherein said striking arm is configured such that after said driving cam reaches the release position and ceases abutting said driven end of said striking arm, momentum of said striking arm carries said striking end from the intermediate position to strike the sound producing body at the second position.

31. A striking mechanism according to claim 30, further comprising a driving plate on which said driving cam is mounted, wherein said driving motor drives said driving plate to drive said driving cam.

32. A striking mechanism according to claim 31, wherein said driving plate comprises a rotating disk and means for biasing said disk toward a neutral position.

33. A striking mechanism according to claim 32, further comprising a stop for limiting rotation of said rotating disk when said cam is at the release position.

34. A musical device comprising:

a base;

a sound producing body provided on said base; and a striking mechanism provided on said base adjacent said sound producing body, said striking mechanism comprising:

a main body attached to said base, a striking arm pivotably connected to said main body at a pivot point, said striking arm having a striking end remote from the pivot point for striking said sound producing body and a driven end remote from the pivot point, said striking end being movable between a first position spaced from said sound producing body and a second position contacting said sound producing body, a driving cam provided on said main body for abutting and driving said driven end of said striking arm to drive said striking end of said striking arm from the first position toward the second position, and a driving motor for driving said driving cam.

35. A musical device according to claim 34, further comprising a driving plate on which said cam is mounted, wherein said driving motor drives said driving plate to drive said driving cam.

36. A musical device according to claim 35, wherein said driving plate comprises a rotating disk and means for biasing the plate toward a home position.

37. A musical device according to claim 36, further comprising a stop for limiting rotation of said rotating disk when said cam is at the release position.

38. A musical device according to claim 34, wherein said sound producing body comprises a chime.

39. A musical device according to claim 34, wherein said sound producing body comprises a bell.

40. A musical device according to claim 34, further comprising control means for controlling said driving motor to drive said cam to drive said striking arm at predetermined times.

41. A musical device according to claim 34, further comprising a second sound producing body having a tone different from that of said sound producing body and said striking mechanism further comprising a second striking arm driven by said cam and said driving motor independently of said striking arm to strike said second sound producing body.

42. A musical device according to claim 41, further comprising control means for controlling said driving motor to selectively drive said striking arm and said second striking arm to respectively strike said sound producing body and said second sound producing body at predetermined times.

43. A musical device according to claim 34 further comprising means for normally biasing said striking arm toward the first position.

44. A musical device according to claim 34, wherein said sound producing body and said striking mechanism are provided in plural number on said base.

45. A striking mechanism comprising:

a main body;

a striking arm pivotably connected to said main body at a pivot point, said striking arm having a striking end remote from the pivot point for striking a sound producing body and a driven end remote from the pivot point, said striking end being movable between a first position spaced from the sound producing body and a second position contacting the sound producing body;

a driving cam provided on said main body for abutting and driving said driven end of said striking arm to drive said striking end from the first position toward the second position, and a driving motor for driving said driving cam.

46. A striking mechanism according to claim 45, further comprising a driving plate on which said driving cam is mounted, wherein said driving motor drives said driving plate to drive said driving cam.

47. A striking mechanism according to claim 46, wherein said driving plate comprises a rotating disk and means for biasing said disk toward a neutral position.

48. A striking mechanism according to claim 47, further comprising a stop for limiting rotation of said rotating disk when said cam is at the release position.

* * * * *